United States Patent [19]

Rango

[11] Patent Number: 4,776,594

[45] Date of Patent: Oct. 11, 1988

[54] GOLF PUTTER

[76] Inventor: Joseph F. Rango, 74470 Fairway Dr., Palm Desert, Calif. 92260

[21] Appl. No.: 43,165

[22] Filed: Apr. 27, 1987

[51] Int. Cl.[4] ..... A63B 53/04; A63B 69/36

[52] U.S. Cl. ..... 273/164; 273/168; 273/167 C; 273/167 A

[58] Field of Search ..... 273/167 C, 168, 169, 273/164, 163 R, 167 B, 167 F, 171, 172, 183 D; D21/218, 217, 219

[56] References Cited

U.S. PATENT DOCUMENTS

| | | | |
|---|---|---|---|
| 823,082 | 6/1906 | Robertson | 273/167 C |
| 1,064,916 | 6/1913 | Kelly et al. | 273/169 |
| 3,333,854 | 8/1967 | White | 273/168 |
| 3,700,244 | 10/1972 | Liotta | 273/167 C |
| 3,901,514 | 8/1975 | Priaulx | 273/168 |
| 4,174,108 | 11/1979 | Reinholz | 273/168 |
| 4,369,974 | 1/1983 | Komperda | 273/168 |

*Primary Examiner*—George J. Marlo
*Attorney, Agent, or Firm*—I. Louis Wolk

[57] ABSTRACT

A golf putter especially adapted to provide training and practice in developing an accurate and precise swing and accuracy in engaging a golf ball by means of a putter head having a spherical contour on one face for putting training and in addition providing a flat putting surface on the opposite face of the club for practice and/or normal use. At the same time the putter is designed to be interchangeable for left or right hand use by providing a downward taper at each side of the club head.

The flat putting surface may be formed with a transparent material to permit the insertion of informational matter.

2 Claims, 1 Drawing Sheet

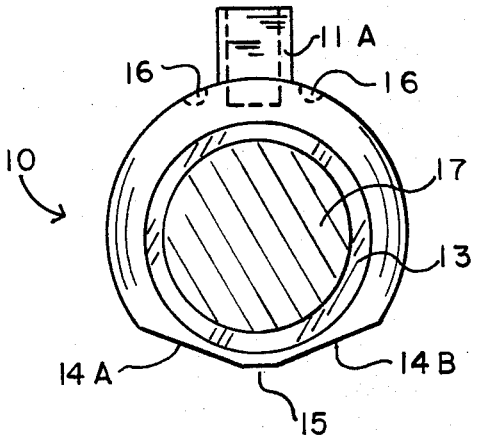
FIG. 1
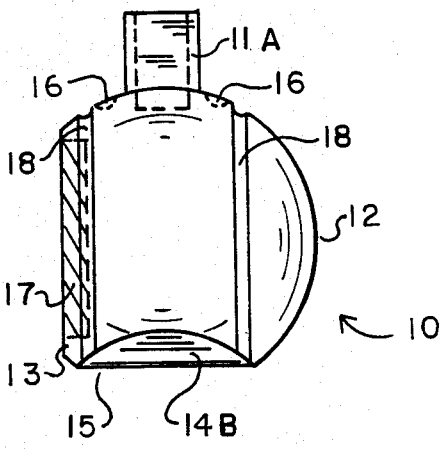
FIG. 2
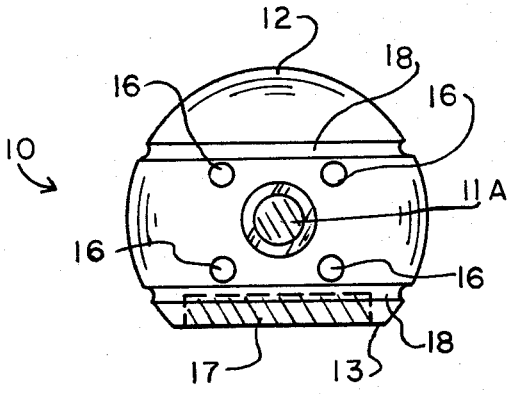
FIG. 3
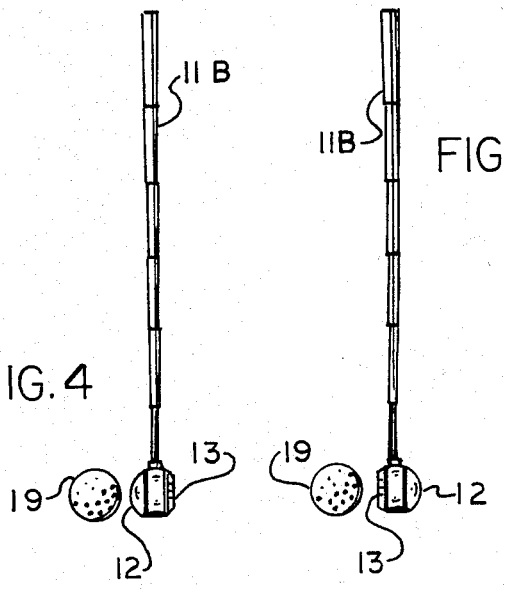
FIG. 4
FIG. 5

GOLF PUTTER

BACKGROUND OF THE INVENTION

This invention relates to a new and improved type of golf putter and one which is especially adapted for training and practice in the use of putters and for developing putting expertise. It may also be adapted for interchangeable use by both left and right handed players and may also be adapted for general use as a putter in addition to its training mode.

Golf putters as commonly designed are formed with a flat or plane putting surface and such surfaces when used for training fail to ensure the correct swing path and type of pendulum stroke which will provide the exactness of impact required to guarantee optimum results.

SUMMARY OF THE INVENTION

In accordance with the present invention, applicant has provided a golf putter especially adapted for training purposes in which the putter surface which impacts the ball is formed with a spherical surface. In the use of such a putting surface it has been found that in order to achieve proper contact between the club surface and the ball, the user must develop a consistent and uniform stroke. Failure to do so will result in deviation of the path of the ball after impact and will require the trainee to make the requisite efforts to acquire the degree of precision necessary to achieve a perfect swing and impact. This appears due to the fact that the contoured surface requires an exact point of impact. This also supplies immediate feedback to the user reflecting the error in the nature and path of the swing even in the case of minute errors.

In addition to the provision of a spherical surface for training purposes the club is provided with a flat plane surface for practice in translating the results using the spherical surface to a flat surface putter. In order to make the same club usable by both right and left handed players the bottom surface of the club is provided with tapers at each side so that a proper club lie may be used when the right-left interchange takes place. The bottom configuration of the club head is designed so that in normal use when the head is raised a slight distance from the surface of the green for clearance, the equator of the club head is adjacent to or slightly below the equator of the ball to ensure proper impact and avoid trapping.

BRIEF DESCRIPTION OF THE DRAWINGS

As shown in the drawings

FIG. 1 is a front view in perspective of the club head

FIG. 2 is a side view in perspective of the club head

FIG. 3 is a top view in perspective of the club head

FIG. 4 is a view showing the putter as used with its spherical training surface FIG. 5 is a view showing the putter as used with its flat putting surface

DETAILED DESCRIPTION

As shown in FIGS. 1, 2 and 3 club head 10 which is attached to shank or hosel 11A is formed with a spherical contoured surface 12 (FIGS. 2 and 3) and a flat face 13 which is formed as a frustum of the sphere along a vertical plane. The flat surface is advantageous as providing a surface which can be used for practice or as a regular putter.

The provision of a flat putting surface on the same club head as the spherical training surface is important since it permits the player to translate the benefits of training with the spherical surface to the flat putting surface for practice or normal use, utilizing the same club with the same weight and balance and to alternately interchange these surfaces as desired.

In order to provide guidance for the angular slope of the club in use the head is formed with slightly downwardly tapered flat surfaces 14A and 14B at the sides of the club head toward the bottom of the club at a preferred angle of 20° to the horizontal taken in the forward direction of the club head as shown in FIGS. 1 and 2. This provides an adjustment for the slight degree of elevation of the club required by the grass of the putting green and to ensure impact at or slightly below the horizontal axis or equator of the ball when the club head is swung with the tapered surface parallel to the green. The resultant effect is to lower the equator of the club head slightly up to say about ¼". This will ensure that the equator of the spherical club head surface at impact will preferably be at or below the equator of the ball. A small flat segment of the club head may be removed at the bottom as shown at 15 if desired to lower the equator if the club is held vertically.

A flat putting head surface is provided by figuratively removing a vertical segment of the spherical club head as shown at 13 to in effect form the frustum of a sphere and the actual impact surface may be in the form of an insert 17 of a rigid plastic material which may if desired be transparent to reveal a decorative or personalized insert placed within it. As guide to alignment of the club head with the ball indicia such as dots or dimples 16 may be placed uniformly at both sides of the shank of the club for directional alignment of the head with the ball.

In addition, spaced grooves or other indicia 18 are provided circumferentially of the club head positioned transversely to the direction of the movement of the ball. This combination of longitudinal and transverse indicia permits the player to properly line up the club head with the ball and to square up the head in both directions. This permits the club head to be suare to the intended direction of the ball.

As shown in FIG. 4, the club with shaft llB is shown in training position of the club head with spherical surface 12 opposed to ball 19. In FIG. 5, the club with shaft 11B and the club head with flat putting surface 13 opposed to ball 19.

The club head may be formed of forged or cast metal such as brass, bronze or steel or may be made of metal composites, aluminum or dense rigid plastic. Dimensionally any convenient dimensions may be adopted. In practice it is found that the diameter of the club head may suitably range from 1¾"–2" with a 1⅞" diameter being preferable.

The flattened bottom surface of the club as shown at 15 may for example represent a flat portion about ¼" in width and may correspond to a decrease in diameter of the head of that order.

The weight of the club head is determined by practical considerations and may depend upon personal preferences of the player. Of course, the weight is a factor of the density of the material used and in any case may be adjusted by forming a cavity behind the flat surface or by incorporating weight if necessary.

I claim:

1. A golf putter head comprising (a) a first ball contacting surface having a spherical configuration adapted to contact a ball at or near the equator thereof, (b) a second alternate ball contacting surface opposite to said first surface having a flat vertical putting surface conforming to a vertical frustum of a sphere, (c) a pair of tapered surfaces at the bottom of the head extending angularly to the ground from the opposite sides of the club head to the bottom center line taken in the direction of movement of the head to permit angular positioning of said head and to slightly lower the equator of the club head to ensure engagement of said head with a ball at a point beneath the equator of the ball and putter head being thereby adapted for use with both of said ball contacting surfaces by either left or right handed players, (d) and wherein indicia are provided at the top of the head at both sides of the center thereof for directional alignment of the club head with the ball in the direction of movement thereof and additional indicia are provided circumferentially of the head transverse to the direction of movement to permit alignment of the club head both laterally and longitudinally of the intended line of the ball.

2. A golf putter head according to claim 1 wherein the indicia for alignment of the club head in the direction of movement comprise a plurality of dimples or depressions spaced at both sides of the shank of the club and wherein the circumferential indicia are in the form of grooves formed around the club head.

* * * * *